US006698645B1

(12) United States Patent
Buchberger et al.

(10) Patent No.: US 6,698,645 B1
(45) Date of Patent: Mar. 2, 2004

(54) METHOD OF PRODUCING FIBER-REINFORCED METALLIC BUILDING COMPONENTS

(75) Inventors: Michael Buchberger, Grafenau (DE); Bertram Kopperger, Hebertshausen (DE); Alexander Sagel, Blochingen (DE); Axel Rossmann, Karlsfeld (DE)

(73) Assignee: MTU Aero Engines GmbH, Munich (DE)

( * ) Notice: Subject to any disclaimer, the term of this patent is extended or adjusted under 35 U.S.C. 154(b) by 0 days.

(21) Appl. No.: 09/673,061

(22) PCT Filed: Feb. 8, 2000

(86) PCT No.: PCT/DE00/00246

§ 371 (c)(1),
(2), (4) Date: Feb. 2, 2001

(87) PCT Pub. No.: WO00/47792

PCT Pub. Date: Aug. 17, 2000

(30) Foreign Application Priority Data

Feb. 9, 1999 (DE) ..... 199 05 100

(51) Int. Cl.[7] ..... B21D 39/00

(52) U.S. Cl. ..... 228/173.1; 228/121; 228/245; 228/193

(58) Field of Search ..... 228/121, 124.7, 228/245, 248.1, 254, 256, 262, 234.1, 235.1, 193

(56) References Cited

U.S. PATENT DOCUMENTS 3,538,593 A 11/1970 King, Jr. et al.
3,748,721 A 7/1973 Alexander
4,147,538 A * 4/1979 Yajima et al. ..... 75/229
4,338,132 A 7/1982 Okamoto et al.
5,400,505 A * 3/1995 Wei et al. ..... 29/460

FOREIGN PATENT DOCUMENTS

| | | |
|---|---|---|
| DE | 2939225 | 4/1980 |
| DE | 4324755 | 9/1994 |
| EP | 0581635 | 2/1994 |
| EP | 0648593 | 4/1995 |

* cited by examiner

*Primary Examiner*—M. Alexandra Elve
*Assistant Examiner*—Len Tran
(74) *Attorney, Agent, or Firm*—W. F. Fasse; W. G. Fasse

(57) ABSTRACT

A method of producing fiber-reinforced metallic building components having a complicated three-dimensional geometric shape includes the following steps. First, metal-coated SiC fibers are applied to a metallic sectional piece having a simple geometric shape, and are then held thereon without restraint by a metallic counterpart piece. Then, the unit consisting of the sectional piece, fibers and counterpart piece undergoes plastic deformation in vacuo between mold halves by applying pressure at an elevated temperature, without bonding of the fibers to one another or to the building component metal. By further increasing the pressure and/or temperature, the molded unit is compressed further between the mold halves and is consolidated to a monolithic part by metallic bonding (diffusion welding), whereby the part, either alone or bonded to other parts, forms the building component, after cooling and removing it from the mold halves.

20 Claims, 3 Drawing Sheets

METHOD OF PRODUCING FIBER-REINFORCED METALLIC BUILDING COMPONENTS

FIELD OF THE INVENTION

This invention relates to a method of producing fiber-reinforced metallic building components, i.e. structural components, with a complicated three-dimensional geometry.

BACKGROUND INFORMATION

The extraordinary strength properties of SiC fibers are known. These properties in combination with their thermal stability has predestined ceramic SiC fibers for use as reinforcing elements for metallic materials. With regard to an intimate, load-transferring connection between the ceramic fibers and the metallic matrix, the fiber must first be provided with a well-adhering surface coating of a metal that is identical or at least "related" to the material of the building component from the standpoint of the subsequent diffusion bonding or diffusion welding. The fiber coating is usually provided by the PVD method, specifically by magnetron sputtering. The fiber-reinforced metallic building components ultimately produced are also known as MMCs (metal matrix composites). SiC fibers are produced as long fibers or continuous fibers with lengths of up to approximately 40 km, but fractions or sections 150 meters in length, for example, are usually used in construction practice. A preferred fiber diameter is approximately 100 $\mu$m. A certain disadvantage of the rigid SiC fiber is its susceptibility to kinking, which is why it can be bent only with a relatively large radius of bending. The minimum bending radius for said 100 $\mu$m fibers is approximately 2.5 cm. Due to the great length of the fiber, it is possible to apply it to building components that are to be reinforced by the winding technique to advantage, of course taking into account the fiber-specific minimum bending radius. Concrete applications so far have been mainly relatively simple rotor elements, e.g., in the form of rotationally symmetrical shafts, disks and rings or combinations of these elements. They should usually be produced by winding a metal-coated SiC long fiber around metallic carriers having a contour that corresponds at least mostly to the final form, covering the fiber windings with the metal, and producing a bonded monolithic structure, i.e., consolidating the resulting prefabricated unit in vacuo under the influence of pressure and temperature, the latter preferably by the HIP method (hot isostatic pressing). In addition to contoured components such as covers, sleeves, pipes, disks, etc., flexible and free-flowing elements such as films, wires, powders and the like may also be used as the covering for the fibers. Because of the favorable strength/weight ratio, titanium and its alloys have a preferred position among the materials to be reinforced. In this regard, see German Patent 4,324,755, for example.

For higher use temperatures, metals such as nickel and cobalt are recommended as matrix materials. Because of the great strength of the SiC fiber and its relatively low density (approx. 3.9 g/cm$^3$) SiC-fiber-reinforced building components practically always permit lighter constructions than corresponding building components made only of metal. This again predestines MMCs with SiC reinforcement for use in high-speed rotors of all types. The fiber content that is currently feasible in the area of reinforcement is approx. 40 vol %.

The problem of production of MMC building components with SiC fiber reinforcement in complex, three-dimensional geometric shapes, e.g., in the form of blades for motors, has not been solved satisfactorily so far. First, it is practically impossible to cover a metal carrier—as a building component precursor—having a complex three-dimensional shape with the "unmanageable" SiC fibers in a defined manner, and definitely not by the preferred winding technique. On the other hand, consolidated SiC fibers, whose metallic surfaces have already formed bonds cannot be deformed permanently without destruction and/or breakage of the fibers.

Against this background, the object of this invention is to provide a method of producing SiC fiber-reinforced metallic building components which makes it possible to produce a defined fiber reinforcement in a reproducible and economical manner especially with the more complex three-dimensional geometric shapes, thus making the use of MMC technology for building components having complex shapes truly possible for the first time.

This object is achieved by process steps A through C characterized in Patent claim 1 in combination with the generic features in the introductory clause.

The above object has been achieved according to the invention in a method of producing a fiber-reinforced metallic building component or structural component. The principle of this invention is that metal-coated SiC fibers forming the fiber reinforcement are applied to a metallic sectional piece having a simple geometry and are held without being restrained thereon by means of a metallic counterpart piece, next the unit of the sectional piece, fibers and counterpart piece is plastically deformed and shaped into the complex final shape whereby the fibers are still "loose" and unbonded, and only then the unit is consolidated into a monolithic part by diffusion bonding. The steps of plastic deformation or shaping and consolidation take place at least mostly separately and in succession in the same device or within the same mold, with the process parameters of pressure, temperature and time being controlled appropriately. After consolidation, the part is still not a finished building component, so additional manufacturing steps such as cutting or joining must then follow.

BRIEF DESCRIPTION OF THE DRAWINGS

This invention is explained in greater detail below on the basis of the drawings, showing in simplified schematic diagrams.

DETAILED DESCRIPTION OF PREFERRED EXAMPLE EMBODIMENTS

Figure 1:
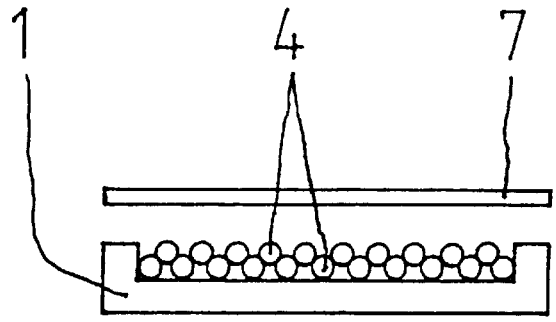
FIG. 1: a cross section through a sectional piece covered with fibers and a counterpart piece.

The geometrically simple metallic sectional piece 1 in FIG. 1 is formed by a U-shaped section having a planar base face and low vertical legs. It is already covered with metal-coated SiC fibers 4—to be more precise, with pieces of one or a few long SiC fibers—and it is to be "sealed" by the metallic counterpart piece 7 like a cover, the latter being secured on the legs of the sectional piece or member 1 by spot welding, for example. The counterpart piece 7 should hold the SiC fibers 4 in their desired position as smoothly as possible so that metallic fiber surfaces still remain displaceable in length relative to one another and relative to the adjacent sectional surfaces with little friction, which is important for the subsequent shaping. The hollow spaces between the fibers can be filled—at least in part—with a metal powder (not shown), so the subsequent consolidation may be facilitated and improved.

Figure 2:
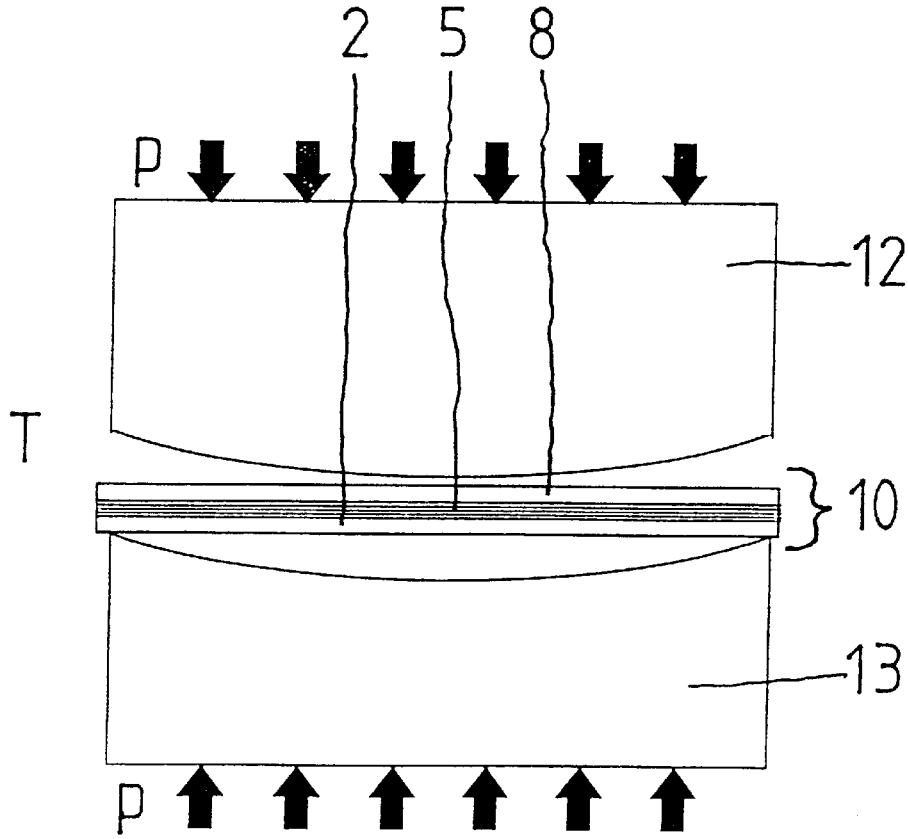
FIG. 2: a section through two molds with a unit to be shaped.

FIG. 2 shows a planar unit 10 of sectional piece 2, SiC fibers 5 and counterpart piece 8 inserted between two mold halves 12, 13 having similar convex and concave curvatures for the contact surfaces. Mold halves 12, 13 belong to a hot press (not shown) whose working space can be evacuated and heated ("T" stands for temperature). The arrows above and below the mold halves 12, 13 including the symbol "p" represent the press pressure, with at least one mold half being designed to move in the direction of the arrow and vice versa. The contact faces of mold halves 12, 13 (shown here with a simple curvature for the sake of simplicity) are usually more complicated, three-dimensional shapes in reality, such as those required for gas turbine blades, for example.

Figure 3:
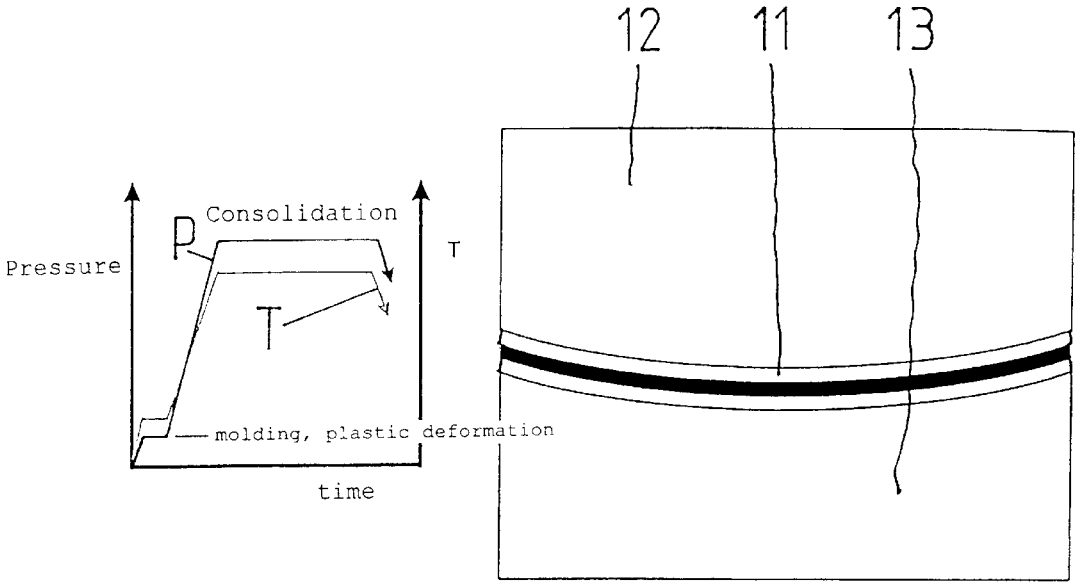
FIG. 3: a diagram showing the pressure and temperature over time in shaping and consolidation and a sectional view comparable to that in FIG. 2, showing a shaped and consolidated part.

FIG. 3 shows at the left a diagram showing curves for pressure (p) and temperature (T) over time for the two process steps "shaping" and "consolidation" which take place in chronological succession in the same device. The curves for pressure and temperature tend to be similar, although that need not always be the case. As an example, the plastic deformation is carried out at a temperature of approximately 800° C. and the consolidation is carried out at a temperature of approximately 950° C.

Starting with the condition illustrated in FIG. 2 with mold halves 12, 13 still opened and after reaching a mold temperature and workpiece temperature at which the metal parts of unit 10 can undergo plastic deformation with no problem, mold halves 12, 13 are moved toward one another at a defined pressure and/or a defined force until unit 10 has undergone complete plastic deformation, i.e., it is in full contact with the contact faces of mold halves 12, 13. During this deformation process, the metal coated SiC fibers 5 must not bond and/or weld to one another or to the adjacent parts 2, 8 because the resulting high shear stresses would interfere with shaping and/or would lead to fiber breakage. Therefore, the pressure p and temperature T must not be too high here. In the p-T-time diagram, this shaping step can be seen in the form of the two small lower plateaus.

After the end of plastic shaping, i.e., after the movable mold half has come to a standstill at an unchanged pressure, the pressure and temperature are increased further to initiate the process step of consolidation, where a monolithic part which is largely free of hollow spaces and has an integrated, load-bearing fiber reinforcement is obtained with further densification of the structure through diffusion bonding and/or welding of the inside metal surfaces. This condition with the finally compressed, consolidated part 11 is shown at the right in FIG. 3. In the pressure-temperature-time diagram, the consolidation corresponds to the two broad upper plateaus.

It may be sufficient to increase only one of the parameters p or T for the transition from plastic deformation to consolidation. Experimental investigations are definitely indispensable in this regard.

It should be pointed out that as a rule, part 11 is still not a finished building component even after being removed from mold halves 12, 13.

Figure 4:
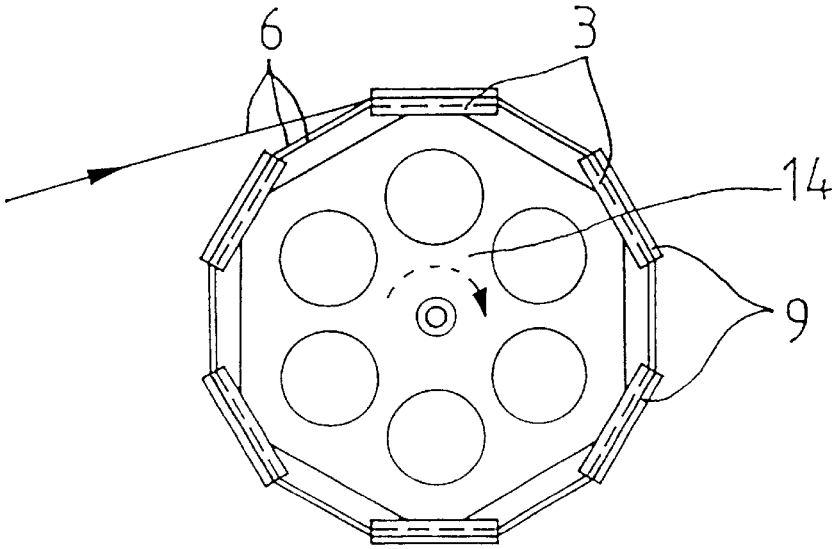
FIG. 4: a rotating carrier with several sectional pieces wrapped with fiber.

FIG. 4 shows an especially economical method of providing a fiber covering for several sectional pieces 3. However, this presupposes a unidirectional fiber orientation—at the beginning. The trick is to arrange several sectional pieces 3 on the periphery of a wheel-shaped rotating carrier 14 in such a way that the theoretical fiber direction of each profile piece 3 runs tangentially. Sectional pieces 3 may be planar or they may have a relatively simple curvature. By rotating the carrier 14 and winding at least one long tangentially supplied SiC fiber 6 around it, the desired coverage is achieved after a certain number of revolutions and a controlled lateral displacement of the fiber feed, i.e., a helical winding, optionally in multiple layers. Then the metallic counterpart pieces 9 are applied and secured so that the SiC fibers are held securely. This condition, with carrier 14 stationary—is shown in FIG. 4 (therefore, the arrow indicating rotation about the axis of the carrier is indicated only with dotted lines). Now the exposed fiber strands between the sectional pieces 3 can be severed and cut back to the ends of the building components so that the units of sectional pieces, fibers and counterpart pieces can be removed separately from the carrier 14. Then each unit undergoes plastic deformation and consolidation as explained above.

It is also conceivable to design the mold halves from FIGS. 2 and 3 so that several prefabricated units, each consisting of sectional piece, fibers and counterpart piece, undergoes plastic deformation and consolidation together, possibly also being bonded together, with the units being arranged side by side/in succession and/or one atop the other between the mold halves.

Figure 5:
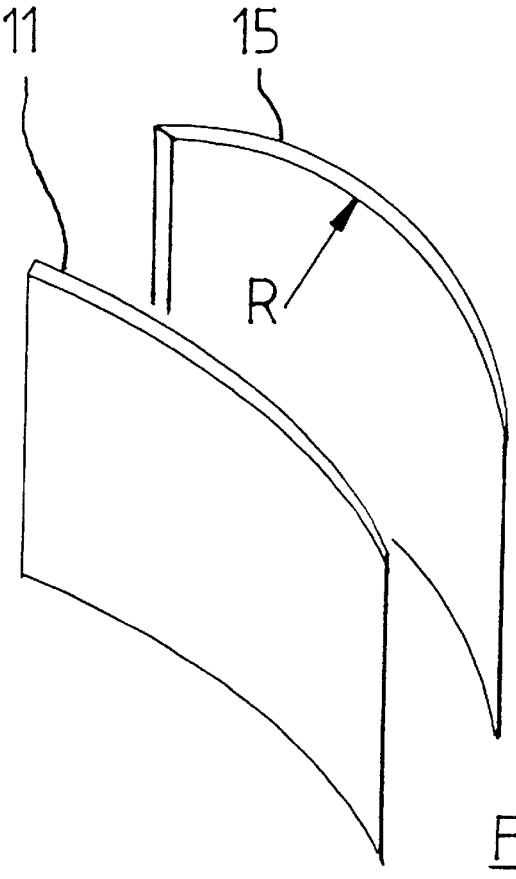
FIG. 5: two consolidated parts to be combined to a hollow paddle or blade.
Figure 6:
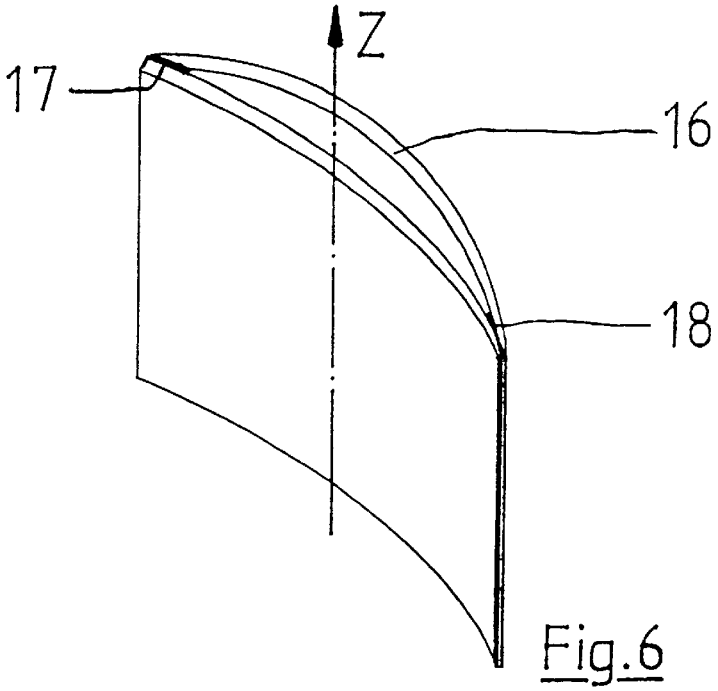
FIG. 6: the blade assembled by joining the parts according to FIG. 5.

FIGS. 5 and 6 concern in particular the production of hollow titanium blades for gas turbines in the axial design.

FIG. 5 shows two separate, shaped and consolidated parts 11 and 15 made of titanium or titanium alloy with integrated SiC fiber reinforcement. The fiber orientation and coverage are adapted to the subsequent operating condition, with the fiber direction being unidirectional or with several orientations. With rotor blades, the fibers run primarily in the direction of centrifugal force, i.e., radially, but with turbine guide vanes, other fiber orientations or multiple fiber orientations may be advantageous, e.g., to counteract vibration modes. The plate-shaped parts 11, 15 have different curvatures to form a hollow flow profile after they are joined.

Reference letter R with an arrow indicates that in the simplest case, the curvature may follow an arc of a circle. Depending on the technical flow requirements, however, three-dimensional curves of almost any shape may be implemented. Parts 11 and 15 have metallic surfaces which can be bonded together in various ways, in particular by soldering and welding. In the meantime, solders and soldering methods have been developed for titanium and its alloys, permitting joints with a strength equal to that of the material of the building component.

In this sense, FIG. 6 shows a hollow blade 16 which is joined by soldering the two parts 11 and 15. The soldered spots are located in the area of the leading edge and the trailing edge of the blade and are labeled as 17 and 18. A longitudinal axis of the blade, preferably the axis of the stack running through the centers of gravity of the section, can be seen here as vertical arrow Z. In a gas turbine using blade 16, the axis Z runs at least mostly radially, starting from the longitudinal center axis of the gas turbine which may also be an aircraft engine. It would be clear to those skilled in the art that the blade 16 shown here is not yet ready for installation. It has no connection elements or function elements, such as footing with or without a platform, an internal and external shroud segment in the case of a turbine guide vane, a wear-resistant blade tip, etc. These elements are made entirely or partially of a comparable metal, in particular a titanium alloy, and they may contain ceramic fibers and/or particles. The elements may consist of different alloys that are adapted to the local operating conditions in the best possible way. Criteria such as the fire resistance of titanium, wear resistance, etc. play a role here. The material integration is preferably achieved by soldering.

This hollow blade design can of course also be used with other fiber-reinforced metals, e.g., those based on iron, nickel or cobalt (Fe, Ni, Co).

What is claimed is:

1. A method of producing a fiber-reinforced metallic building component with a complicated three-dimensional final geometric shape, characterized by the following process steps:

A) metal-coated SiC fibers (4, 5, 6) are applied in a desired number, distribution and orientation to a metallic sectional piece (1, 2, 3) having a simple geometric shape different from the complicated three-dimensional final geometric shape, and the fibers are then held without restraint by a metallic counterpart piece (7, 8, 9) secured on the sectional piece (1, 2, 3);

B) the unit (10) of the sectional piece, the fibers and the counterpart piece (2, 5, 8) undergoes plastic deformation into the final geometric shape, in vacuo between mold halves (12, 13) under elevated pressure and elevated temperature at which no mentionable bonding of the fibers (5) to one another or of the fibers (5) to the sectional piece or to the counterpart piece occurs; and C) by further increasing the pressure and/or temperature after the step B), the unit (10) is compressed further between the mold halves (12, 13) and undergoes consolidation to a monolithic part (11, 15) by diffusion bonding and/or welding, whereby the monolithic part, either alone or bonded to other parts, forms the building component (16), after cooling and removing the monolithic part from the mold halves (12, 13).

2. A method according to claim 1, characterized in that titanium and/or at least one alloy based on titanium is/are used as a coating metal of the metal-coated SiC fibers and as a metal of the sectional piece and of the counterpart piece.

3. A method according to claim 1, characterized in that one of the elements nickel (Ni), cobalt (Co) and iron (Fe) and/or at least one alloy based on one of these elements is/are used as a coating metal of the metal-coated SiC fibers and as a metal of the sectional piece and of the counterpart piece.

4. A method according to claim 1, characterized in that a planar section or a simple-curved section of a semifinished article is used as the metallic sectional piece (1, 2, 3).

5. A method according to claim 2, characterized in that the step of plastic deformation is performed at a temperature of approximately 800° C., and the step of consolidation is carried out at a temperature of approximately 950° C.

6. A method according to claim 1, characterized in that the counterpart piece (7, 8, 9) is secured on the sectional piece (1, 2, 3) by spot welding.

7. A method according to claim 1, characterized in that several metallic sectional pieces (3) are arranged on the periphery of a wheel-shaped carrier (14) and are oriented tangentially with regard to their fiber orientation, the sectional pieces (3) are wrapped jointly with at least one long SiC fiber (6) while rotating the carrier (14) until achieving a predetermined fiber count per building component, a cover-like counterpart piece (9) is attached to each sectional piece (3) with local coverage of the fiber windings, the open fiber strands joining the sectional pieces (3) are severed and removed in the area of the ends of the sectional pieces, and the units thus separated, each consisting of a sectional piece, fibers and a counterpart piece (3, 6, 9), are removed from the carrier (14) and then undergo plastic deformation and consolidation in additional steps.

8. A method according to claim 1, characterized in that several units, each consisting of a sectional piece, SiC fibers and a counterpart piece, undergo plastic deformation and consolidation together between mold halves, and are joined together by metallic bonding, with the units being arranged side by side in succession and/or one atop the other between the mold halves.

9. A method according to claim 1, characterized in that at least two plastically deformed and consolidated parts (11, 15) having the same or different geometric shapes are bonded together to form a hollow building component (16), preferably by soldering and/or welding.

10. A method according to claim 9, characterized in that two consolidated plate-shaped parts (11, 15), in particular parts with titanium (Ti) as the base metal but having different curvatures, are joined together to form a hollow blade (16), in particular by soldering (17, 18).

11. A method according to claim 10, characterized in that two plate-shaped parts (11, 15), each with an arc-shaped curvature across the subsequent longitudinal axis (Z) of the blade, are joined.

12. A method according to claim 10, characterized in that other parts selected from the group consisting of a footing, a platform, one or two shroud segments and a blade tip are attached to the hollow blade (16), where different alloys having special properties can be used for the other parts, and the joining methods required for the blade (16) and those required for the other parts can be carried out at the same time or in succession.

13. A method of producing a fiber-reinforced metallic component, comprising the steps:

a) providing metal-coated SiC fibers;

b) arranging said metal-coated SiC fibers on a metal base member;

c) arranging a metal counter member on said metal-coated SiC fibers on said metal base member and securing said metal counter member onto said metal base member so as to loosely hold said fibers without restraining said fibers against relative motion, thereby forming a unit that comprises said metal base member, said metal-coated SiC fibers, and said metal counter member, and that has a first geometric shape;

d) subjecting said unit to a first elevated temperature and a first elevated pressure in a vacuum in a mold, and thereby plastically deforming said unit from said first geometric shape to a second geometric shape different from said first geometric shape, without restraining said metal-coated SiC fibers against relative motion, and without bonding said metal-coated SiC fibers to each other or to said metal base member or to said metal counter member; and e) subjecting said unit to at least one of a second elevated temperature greater than said first elevated temperature and a second elevated pressure greater than said first elevated pressure in said mold, and thereby diffusion bonding and/or welding said metal-coated SiC fibers to each other, to said metal base member and to said metal counter member, and thereby consolidating said unit into a monolithic part forming said fiber-reinforced metallic component while maintaining said second geometric shape.

14. The method according to claim 13, wherein said second geometric shape is more complex and includes a more sharply curved contour than said first geometric shape.

15. The method according to claim 13, wherein said metal-coated SiC fibers comprise SiC fibers and a coating of titanium thereon, and said metal base member and said metal counter member consist of titanium.

16. The method according to claim 13, wherein said metal-coated SiC fibers comprise SiC fibers and a coating of a titanium-based alloy thereon, and said metal base member and said metal counter member each respectively consist of a titanium-based alloy.

17. The method according to claim 13, wherein said first elevated temperature and said first elevated pressure are respectively held constant during said plastic deforming, and said second elevated temperature and said second elevated pressure are respectively held constant during said diffusion bonding and said consolidating.

18. The method according to claim 17, wherein said step e) comprises subjecting said unit to both said second elevated temperature higher than said first elevated temperature and said second elevated pressure higher than said first elevated pressure.

19. The method according to claim 13, wherein said step e) comprises subjecting said unit to both said second elevated temperature higher than said first elevated temperature and said second elevated pressure higher than said first elevated pressure.

20. The method according to claim 19, wherein said second elevated temperature is 150° C. greater than said first elevated temperature.

* * * * *